United States Patent [19]

Audi et al.

[11] Patent Number: 4,945,827

[45] Date of Patent: Aug. 7, 1990

[54] ROTARY TAMPON PRINTING MACHINE FOR PRINTING THE EDGE OF AUTOMBOILE GLAZINGS

[75] Inventors: Josef Audi; Hans Ohlenforst, both of Aachen, Fed. Rep. of Germany; Peter Bergstein, Eh Kerkrade, Netherlands

[73] Assignee: Saint-Gobain Vitrage, Aubervilliers, France

[21] Appl. No.: 338,950

[22] Filed: Apr. 17, 1989

[30] Foreign Application Priority Data

Apr. 22, 1988 [DE] Fed. Rep. of Germany ..... 3813583

[51] Int. Cl.[5] ..... B41F 17/00

[52] U.S. Cl. ..... 101/35; 101/154; 101/124; 101/376

[58] Field of Search ..... 101/154, 158, 376, 217, 101/492, 41, 35, 36, 37, 40, 114, 129, 124; 427/284, 285

[56] References Cited

U.S. PATENT DOCUMENTS

| | | | |
|---|---|---|---|
| 441,129 | 11/1890 | Bradford | 101/36 |
| 3,424,082 | 1/1969 | Gray, Jr. | 101/40 |
| 4,268,545 | 5/1981 | Hodulik | 101/129 X |
| 4,300,934 | 11/1981 | DeTorre | 427/284 X |

FOREIGN PATENT DOCUMENTS

| | | | |
|---|---|---|---|
| 829350 | 3/1938 | France | 427/284 |
| 124653 | 7/1983 | Japan | 101/35 |

*Primary Examiner*—Clifford D. Crowder

*Attorney, Agent, or Firm*—Oblon, Spivak, McClelland, Maier & Neustadt

[57] ABSTRACT

A rotary tampon printing machine to print the edge area of automobile glazings is distinguished in that the tampon placed on the tampon roller exhibits a flange whose surface that transfers the printing ink corresponds to the frame-shaped printing design. As a block there is a screen printing stencil that is placed above the tampon roller. The tampon roller transfers the printing ink from the screen printing stencil to the glass sheet.

13 Claims, 3 Drawing Sheets

F1
F2
H

ROTARY TAMPON PRINTING MACHINE FOR PRINTING THE EDGE OF AUTOMBOILE GLAZINGS

BACKGROUND OF THE INVENTION

1. Field of the Invention:

The invention relates to a rotary tampon printing machine for printing large-area objects such as automobile glazings, with a block that keeps the printing ink in the desired design and a tampon roller made of a cylindrical roller body that transfers the printing ink from the block to the object and a tampon placed on the surface area of the cylindrical roller body.

2. Description of the Related Art:

In known rotary tampon printing machines, the tampon placed on the roller body of the tampon roller has the form of a hollow cylinder with a continuously even wall thickness. The block, for its part, is also made as a roller in the known rotary tampon printing machines, and the ink transfer to the block roller occurs in that the block roller takes up the printing ink by dipping into a container containing the printing ink, and the excess printing ink above the container is wiped off by a wiper lying against the roller surface.

A condition for satisfactory printing is that the contact pressure of the tampon roller along the contact line or along the striated contact surface with the object to be printed is evenly high and exhibits a certain minimum amount. The larger the surface to be printed, the more difficult it is to achieve an evenly high contact pressure.

A relatively large surface is exhibited, for example, by automobile glazings, in particular windshields or rear windows. But automobile glazings are increasingly being printed along the sheet edge on one side with a decorative border. Up to now, the imprinting of the decorative border has been performed exclusively using the screen printing process.

Imprinting a decorative border on automobile glazings using the screen printing process is, for its part, subject to specific drawbacks. Therefore, performing the inking right up to the edge of the glass sheets in the screen printing process, which is nevertheless desired for certain reasons, is in practice connected with great difficulties. Using the screen printing process, it is even completely impossible to apply the printing ink around the edge of the glass sheet. But that can also be suitable and desirable in certain cases.

SUMMARY OF THE INVENTION

Accordingly, one object of the invention is to design a novel rotary tampon printing machine that is suitable in particular for printing the edge of plane or curved glass sheets.

According to the above object, a rotary tampon printing machine for printing on a portion of a largearea object comprises a block containing printing ink in a desired design; a tampon roller forming a cylindrical roller body and having a peripheral surface area; and a flange-like tampon having a printing surface area and being mounted on the peripheral surface area of the tampon roller, said tampon having means for transferring the printing ink from the block to the large-area object, the printing surface area of the tampon being substantially less than the peripheral surface area of the tampon roller. Through this arrangement high-pressure printing can be achieved on large area objects.

According to a further object of the invention, the rotary tampon printing machine can print an edge area of glass sheets, with the flange-like tampon forming a continuous frame-like shape defining a recess, wherein, the printing surface area of the tampon is less than the are of the recess.

If, for example, a glass sheet is to be provided on one side along its periphery with a framelike inking, on the one hand the block is provided with a self-contained ink groove that takes up the printing ink and, on the other hand, on the tampon roller there is placed a tampon whose form corresponds to the ink groove on the block.

A series of advantages are achieved by the invention. On the one hand, the printing process can be performed with a considerably reduced contact pressure because the tampon comes into contact with the glass sheet only where an inking in fact occurs. Even if such contact strips run parallel to the axis of the tampon roller, the contact pressure to be applied is significantly less than with a tampon of the previous form, because the tampon strip in question can easily deform in the crosswise direction of the strip. Further, printing the glass sheet up to the edge results in the possibility of applying a pressure so high that the tampon strip deforms and in doing so partially lies around the edge of the glass sheet. In this way, it is possible to perform the inking up to around the edge, or also to print the entire peripheral surface of the glass sheet. Finally, another advantage lies in the fact that the danger of contaminating the glass surfaces that are not to be printed is completely precluded.

In an especially suitable way, the block can be a plane screen printing stencil from whose underside the tampon roller takes on the printing ink and on whose top side the printing ink is applied in a known way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
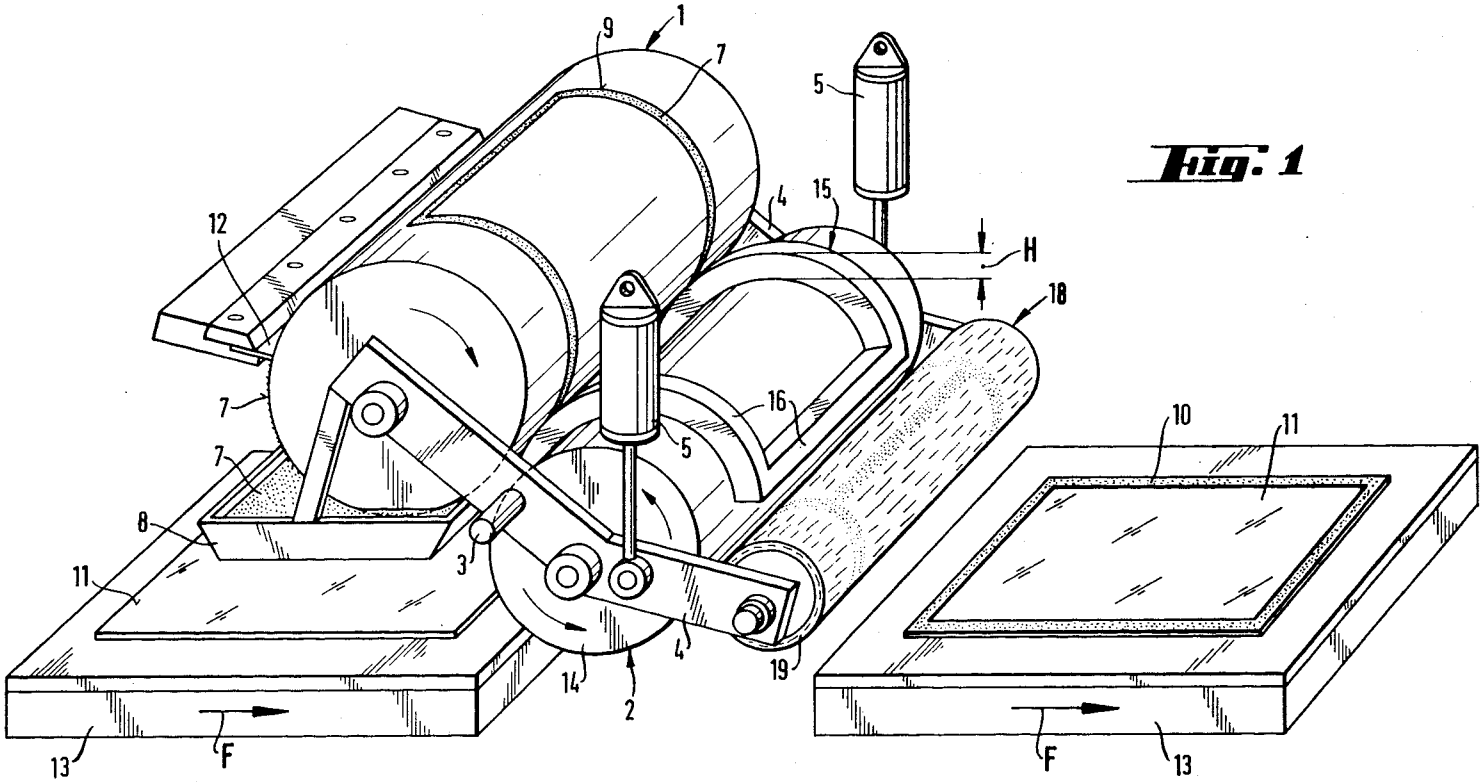
FIG. 1 shows, a rotary tampon printing machine with a block roller.

The rotary tampon printing machine shown in FIG. 1 includes, as essential components, block roller 1 and tampon roller 2, which are synchronized and driven in opposite directions. Both rollers 1 and 2 are mounted together on a frame 4 that can pivot around pin 3, so that a constant distance is guaranteed between rollers 1 and 2. Printing cylinders 5 take care of the required contact pressures during the printing process.

Block roller 1 dips into ink 7, which is in ink container 8, and it is moistened by ink 7. In block roller 1 there is an ink groove 9 in the shape of a closed curve. The shape of ink groove 9 corresponds to the shape of border 10, which is to be printed on glass sheet 11. Further, the surface of block roller 1 has the shape of a smooth cylinder. Using wiper 12 that lies against the surface of the block roller 1, the excess ink is wiped off block roller 1 so that only ink groove 9 is filled with ink.

Tampon roller 2 consists of a metallic roller body 14 and tampon 15 placed on this roller body 14 and made of a rubber elastic, pliable material. The outside diameter of tampon 15 corresponds to the outside diameter of block roller 1. The shape of tampon 15 corresponds to the shape of ink groove 9, but the contact surfaces of flanges 16 of tampon 15 are suitably somewhat wider than ink grooves 9. Tampon 15 is oriented on roller body 14 so that corresponding parts of tampon 15 and ink groove 9 move on each other in rolling contact.

The surface of tampon 15 coming into contact with ink groove 9 transfers the ink from ink groove 9 to glass sheet 11, which is moved in the direction of arrow F relative to the printing machine.

Tampon 15, matched in its outside contact surface to the desired printing design, has overall the form of a hollow cylindrical body, on whose outside surface the desired form of the tampon is carved out. Height H of flanges 16 of tampon 15, whose outside cylinder segment-shaped surface performs the actual printing operation, is adjusted essentially according to the properties of the material used for tampon 15 and, if a curved glass sheet is to be printed, optionally according to the extent of the curvature of the glass sheet to be printed. Height H of flanges 16 of tampon 15 can accordingly be varied within wide limits.

Another roller 18 is also mounted to rotate behind tampon roller 2 on frame 4. The surface of this roller 18 is provided with a sheath 19 of an absorbent material, in particular on an absorbent paper. The surface of roller 18 is in friction contact with tampon 16 of the tampon roller and is made to rotate by the latter. Remaining ink that stayed after printing on the printing surface of tampon 15 is taken up by absorbent sheath 19, so that it is not a problem for the next printing operation.

Figures 2, 2A:
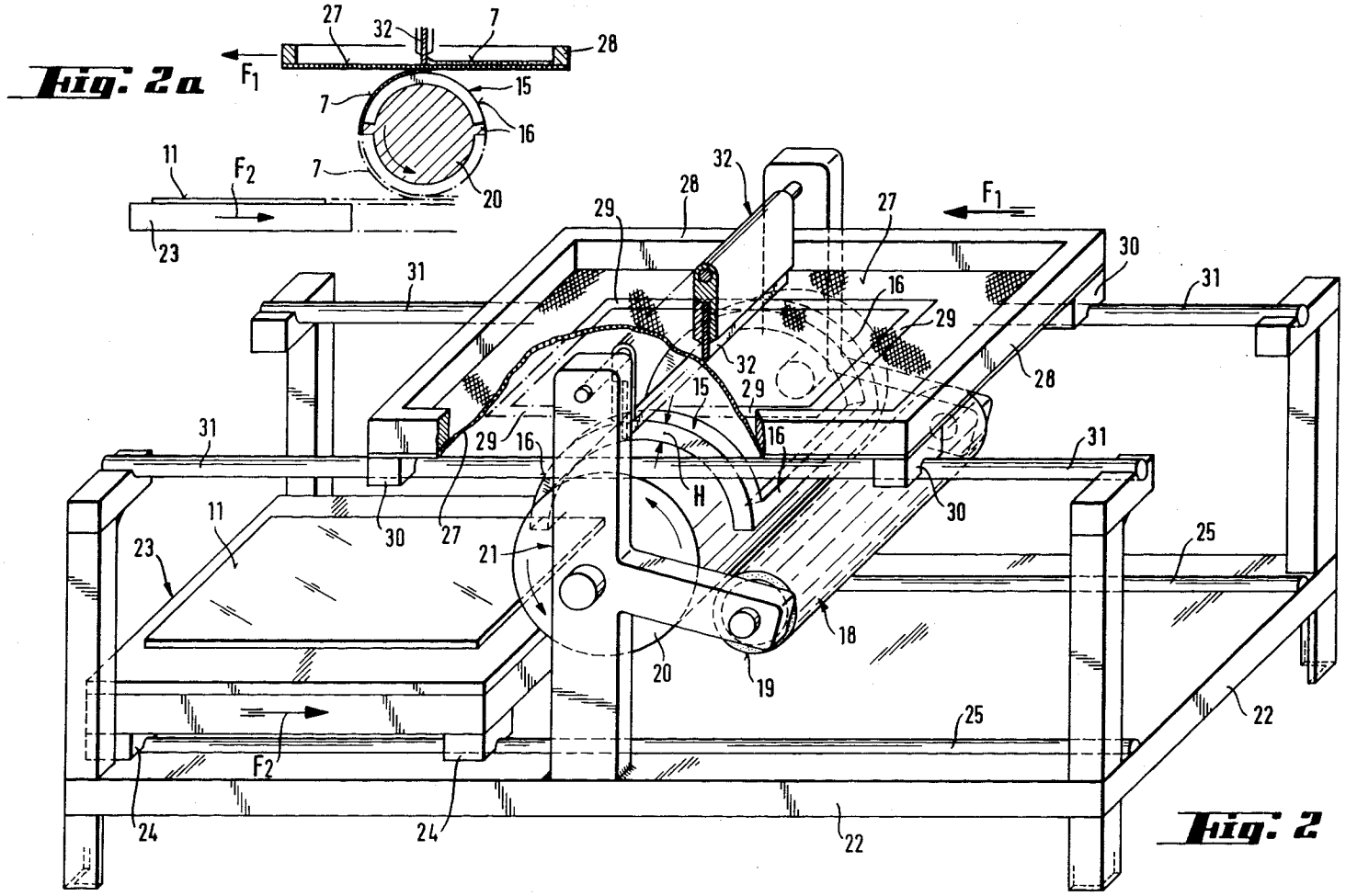
FIG. 2 shows, a first embodiment of a rotary tampon printing machine with a screen printing stencil as a block.
FIG. 2*a* shows a view in cross section of a part of the device of FIG. 2.

FIG. 2 represents, in diagrammatic representation, a rotary tampon printing machine in which a screen printing stencil is used as a block. Tampon roller 20 shown in detail in FIG. 2*a* is, as in the embodiment described above, again provided on its cylinder surface with a tampon 15 that consists of a raised flange 16 exhibiting the form of a self-contained frame or that exhibits such a flange 16.

Tampon roller 20 is mounted in a holder 21 that is placed stationary as such on frame 22 of the machine. Glass sheet 11 to be printed lies on a sliding carriage 23 that can be moved by friction bearings 24 on rails 25 in the lengthwise direction of the machine.

The block in this case is screen printing stencil 27, which is stretched in the usual way in a metal frame 28. Screen printing stencil 27 contains, also in the usual way, printing design 29 in which the areas of the screen printing fabric that correspond to printing design 29 remain open, while for the remaining areas the screen printing fabric is covered by a suitable coating. Metal frame 28 can be moved by friction bearings 30 on sliding rails 31 in the lengthwise direction of the machine.

The inking is performed, also in the usual way, onto screen printing stencil 27, and the printing ink is transferred using wiper 32 within printing design 29 through the screen printing fabric onto tampon 15.

Also as in the embodiment described above, there is placed on holder 21 another freely rotatable roller 18 with a sheath 19 whose object it is to remove remaining ink possibly staying on the printing surface of tampon 15 after the printing operation.

The machine of course includes the necessary drive devices for tampon roller 20, sliding carriage 23 and metal frame 28 carrying screen printing stencil 27, as well as the suitable control devices for them.

The drawing represents one position of frame 28 that carries the screen printing stencil, of tampon roller 20 and of sliding carriage 23 carrying glass sheet 11 at a point at which the machine has already begun its work cycle. Sliding carriage 23 is still in its starting position. Frame 28 with screen printing stencil 27 is already moving in the direction of arrow $F_1$. Tampon roller 20 also has already begun its rotary movement. The printing surface of flanges 16 of tampon 15 is in contact with the underside of screen printing stencil 27 and moves, in synchronized movement with the screen printing stencil, in rolling contact with printing design 29. Wiper 32, which is placed opposite the contact line between tampon 15 and the screen printing stencil above the screen printing stencil and acts on the screen printing stencil presses the printing ink through the screen printing fabric onto the printing surface of tampon 15 which, in this way, takes on the printing ink from the screen printing stencil in the desired printing design and in the required layer thickness.

The rotary movement of tampon roller 20 and the linear movement of sliding carriage 23 in the direction of arrow $F_2$ are synchronized so that flange 16 of tampon 15 transfers the printing ink to the desired point on glass sheet 11. After performing the printing operation, frame 28 with the screen printing stencil is in its final position on the other end of sliding rails 31, and sliding carriage 23 also assumes its final position, which is opposite the starting position. After removing the printed glass sheet from sliding carriage 23, sliding carriage 23 and frame 28 with the screen printing stencil are moved again back to the starting position, and during this moving operation and by suitable means, which are not represented for simplicity's sake, care is to be taken that wiper 32 stays out of contact with screen printing stencil 27.

But it is also possible to operate the machine in both directions. This means that sliding carriage 23 and screen printing stencil 27 need not be moved back to their starting position to perform the next printing operation but that, in each final position of sliding carriage 23 after removal of the printed glass sheet, a new glass sheet can be placed on sliding carriage 23 and, with each movement of screen printing stencil 27, the transfer of the printing ink to the tampon roller occurs. But in this case a second cleaning roller 18 must be placed on the other side of tampon roller 20 and means must be provided by which both cleaning rollers can be brought alternately into contact with tampon roller 20.

Figures 3, 4, 5:
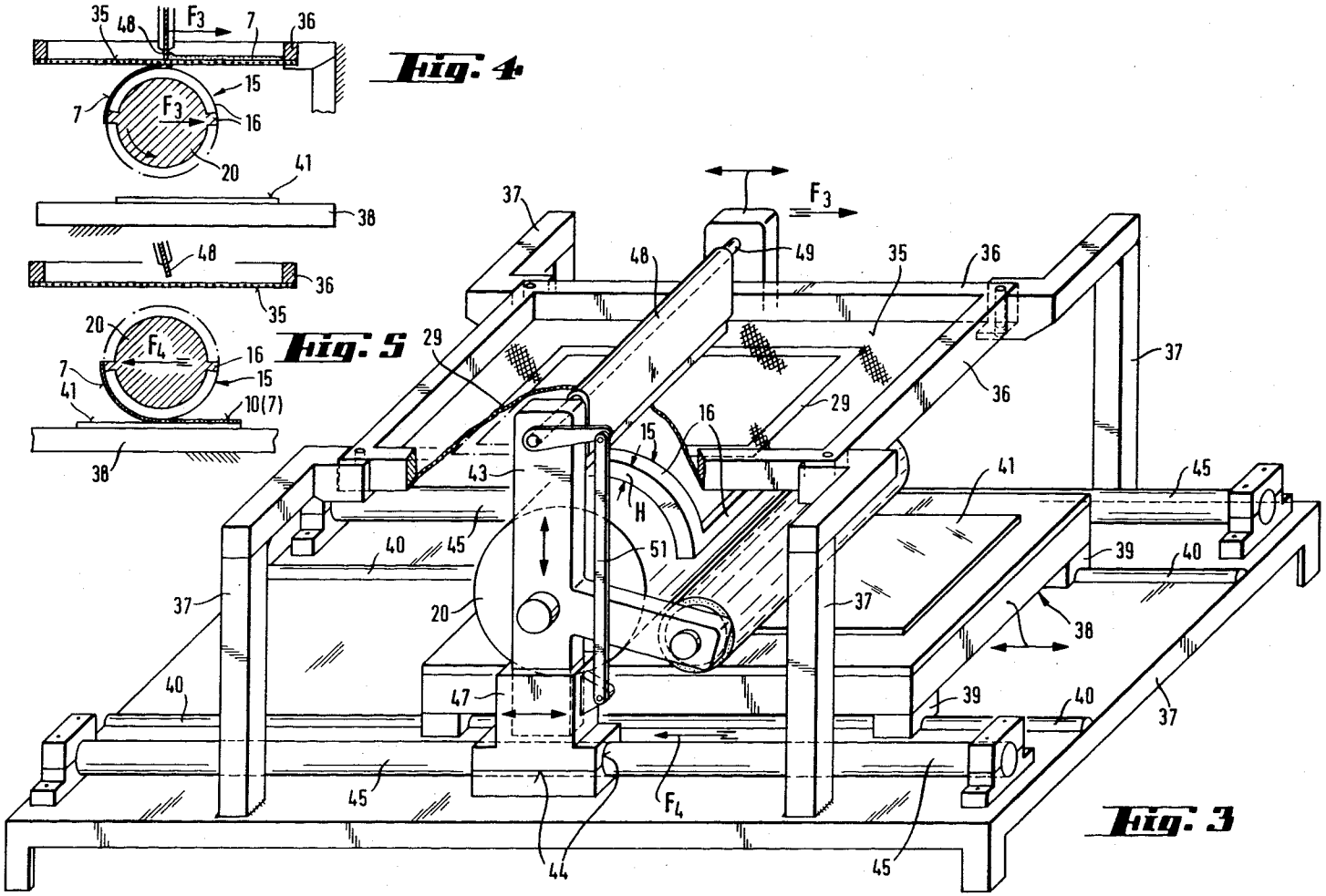
FIG. 3 shows, a second embodiment of a rotary tampon printing machine with a screen printing stencil as a block.
FIGS 4 and 5 show crosswise views of details of the operation of the device of FIG. 3.

The rotary tampon printing machine represented in FIGS. 3 to 5 in its basic configuration differs from the embodiment just described basically in that screen printing stencil 35 is placed stationary on machine frame 37 and tampon roller 20 is placed slidably. Sliding carriage 38 is mounted slidably by friction bearings 39 on rails 40, but sliding carriage 38 is moved out of the printing zone only for the purpose of laying glass sheet 41 on sliding carriage 38 or of removing the printed glass sheet from the sliding carriage. During the printing operation, sliding carriage 38 with glass sheet 41 stays in the work position represented.

Of course, it is also possible to move sliding carriage 38 during the printing operation, since that matters is only the relative movement between tampon roller 20 and sliding carriage 38.

Tampon roller 20 with tampon 15 made in the form of flange 16 is, in this case, placed to slide in the lengthwise direction of the machine in that holder 43 is provided with sliding runners 44 that slide on slide rails 45. Further, holder 43 is mounted adjustably in one of bases 47 carried by sliding runners 44 at a height such that tampon 15 placed on tampon roller 20 lies, in the upper final position, against the lower surface of screen printing stencil 35 and, in the lower final position, against the surface of glass sheet 41. Wiper 48 is placed to pivot around pin 49 above screen printing stencil 35 on holder 43 carrying the tampon roller. The pivoting occurs by lever 50 and rod 51 during the upward and downward movement of holder 43.

The printing operation occurs in that tampon roller 20 first is moved in the direction of arrow $F_3$, and it is in its upper final position. On this path, the printing surface of tampon 15 takes on the printing ink from screen printing stencil 35, and wiper 48 is in the lowered position and transfers the printing ink through the uncoated surfaces of the screen printing fabric to tampon 15.

When the tampon roller has taken on the ink for the entire printing design, i.e., upon reaching its rear final position, holder 43 is lowered with tampon roller 20. Simultaneously, wiper 48 swings upward. Then the tampon roller is moved in the opposite direction, i.e., in the direction of arrow $F_4$. With this moving operation, the printing ink is transferred to glass sheet 41.

What is claimed as new and desired to be secured by Letters Patent of the United States is:

1. A rotary tampon printing machine for printing on a portion of a large-area object comprising:
   - a block containing printing ink in a desired design;
   - a tampon roller forming a cylindrical roller body and having a peripheral surface area; and
   - a flange-like tampon having a printing surface area and being mounted on the peripheral surface area of the tampon roller, said tampon having means for transferring the printing ink from the block to the large-area object, the printing surface area of the tampon being substantially less than the peripheral surface area of the tampon roller, said flange-like tampon forming a continuous frame-like shape defining a recess, wherein the printing surface area of said tampon is less than the area of the recess;
   - whereby high-pressure printing can be achieved on large area objects.

2. Rotary tampon printing machine according to claim 1, wherein:
   - said rotary tampon printing machine is for printing on an edge area of glass sheets.

3. Rotary tampon printing machine according to claim 2, wherein:
   - the block is made in the form of a block roller, and an outside diameter of a printing design of the tampon mounted on the tampon roller is equal to an outside diameter of the block roller.

4. Rotary tampon printing machine according to claim 3, comprising:
   - means for driving the block roller and the tampon roller in opposite directions and in synchronization.

5. Rotary tampon printing machine according to claim 2, wherein:
   - the block is a plane screen printing stencil from whose underside the tampon roller takes on the printing ink.

6. Rotary tampon printing machine according to claim 5, wherein:
   - a screen printing wiper is mounted above a contact line between the tampon roller and the screen printing stencil.

7. Rotary tampon printing machine according to claim 6, wherein:
   - the tampon roller is mounted in a holder placed stationary on a machine frame, wherein there is mounted, below the tampon roller, a sliding carriage on which the glass sheet to be printed is slidably mounted, and wherein, above the tampon roller, the screen printing stencil is mounted to slide in a direction opposite that of the sliding carriage.

8. Rotary tampon printing machine according to claim 6, wherein:
   - the tampon roller and the wiper are mounted in a holder, said holder being slidable in a vertical as well as in a horizontal direction, and wherein the screen printing stencil is placed stationary on a machine frame, and the tampon roller in its upper final vertical position takes on the printing ink from the screen printing stencil during the horizontal movement of the holder and transfers it in its lower final vertical position to the glass sheet.

9. Rotary tampon printing machine according to claim 8, wherein, during the transfer of the printing ink to the glass sheet, means are provided for moving the slidable holder that carries the tampon roller over the sliding carriage while the tampon roller rests in its lower final vertical position.

10. Rotary tampon printing machine according to claim 8, wherein, during the transfer of the printing ink to the glass sheet, means are provided for moving the holder carrying the tampon roller, and the sliding carriage, in opposite directions to each other.

11. Rotary tampon printing machine according to claim 10, wherein, during the relative movement of the tampon roller and the screen printing stencil into their respective starting positions, means are provided for pivoting or sliding the wiper into a position in which it is not in contact with the screen printing stencil.

12. Rotary tampon printing machine according to claim 11, wherein, for printing curved convex glass sheets, a depth of the large-area recesses or a height of the flanges of the tampon corresponding to the printing design corresponds to the extent of the curvature of the glass sheet.

13. Rotary tampon printing machine according to claim 12, wherein, horizontally behind the tampon roller there is provided a roller in friction contact with the tampon roller, said roller being mounted to rotate freely and having a surface area that is provided with an absorbent coating for removing remaining ink from the printing surfaces of the tampon.

* * * * *